US006202800B1

(12) United States Patent
Müller et al.

(10) Patent No.: US 6,202,800 B1
(45) Date of Patent: Mar. 20, 2001

(54) EQUIPMENT FOR CARRYING OUT OPERATIONS IN AN ELEVATOR SHAFT

(75) Inventors: Rolf Müller, Shizuoka (JP); Hanspeter Bloch, Buchrain (CH)

(73) Assignee: Inventio AG, Hergiswil (CH)

( * ) Notice: Subject to any disclaimer, the term of this patent is extended or adjusted under 35 U.S.C. 154(b) by 0 days.

(21) Appl. No.: 09/564,184

(22) Filed: May 4, 2000

(30) Foreign Application Priority Data

May 7, 1999 (EP) ..... 99810399

(51) Int. Cl.[7] ..... B66B 11/02
(52) U.S. Cl. ..... 187/401; 187/414
(58) Field of Search ..... 187/401, 414, 187/336, 337, 338, 339, 340, 341, 342, 240; 312/306, 312, 325

(56) References Cited

U.S. PATENT DOCUMENTS 1,406,942 * 2/1922 Dean ..... 187/350
4,166,517 * 9/1979 Henderson ..... 187/261
4,415,066 * 11/1983 Mensik ..... 187/242

FOREIGN PATENT DOCUMENTS

171423 * 5/1906 (DE) ..... 187/414
05097357 4/1993 (JP) .
405246662 * 9/1993 (JP) ..... 187/401
405330752 * 12/1993 (JP) ..... 187/401

* cited by examiner

*Primary Examiner*—Dean J. Kramer
*Assistant Examiner*—Paul T. Chin
(74) *Attorney, Agent, or Firm*—MacMillan, Sobanski & Todd, LLC

(57) ABSTRACT

A maintenance trestle is stowed in folded-together form below the floor of an elevator car. The maintenance trestle is erected by tilting the floor up towards the car wall about a first fulcrum. The maintenance trestle includes a platform hinged to at least one fastening point on the bottom side of the tilted-up floor and at least one support hinged to the platform at a fulcrum opposite the fastening point and engaging the elevator car. The floor and the support position the platform in an extended position wherein a person standing on the platform can reach through a hatch in the car ceiling to work in the elevator shaft. A stay for stabilizing the maintenance trestle can extend between the fulcrum on the platform and another fulcrum on the car.

11 Claims, 1 Drawing Sheet

EQUIPMENT FOR CARRYING OUT OPERATIONS IN AN ELEVATOR SHAFT

BACKGROUND OF THE INVENTION

The present invention relates to equipment for carrying out operations in an elevator shaft, in which an elevator car with a maintenance trestle, from which the operations can be performed, is movable.

Equipment for the servicing of shaft equipment of an elevator installation is shown in the Japanese patent specification 05097357. A platform which is tiltable out of the car wall and serves as a standing surface for the engineer during servicing operations is provided in an elevator car. Provided in the roof of the elevator car is a hatch which is closable by means of a cover and which affords access to the shaft equipment. The engineer stands up on the platform and can carry out the operations in the shaft with his upper body protruding out of the car.

A disadvantage of the known equipment resides in the fact that the car wall supporting the platform has to be mechanically reinforced and in addition fittings for the tilting and fixing of the platform are necessary, at which the elevator users can be caught by articles of clothing or objects, because the platform is disposed in the standing region of the elevator users.

SUMMARY OF THE INVENTION

The present invention concerns an elevator car movable in an elevator shaft and including a plurality of car walls extending between a car floor and a car ceiling to form a car interior, the car ceiling having a hatch formed therein for access to an elevator shaft, the car floor being tiltable toward one of the car walls at a first fulcrum. A maintenance trestle is stowable under the car floor and has a platform for supporting a person and at least one foldable support. The platform is hinged to a bottom side of the car floor for supporting the platform in an extended position in the car interior when the car floor is tilted toward the one car wall. The foldable support is hinged to the platform at a second fulcrum and engages the car interior for supporting the platform in the extended position whereby a person standing on the platform can reach through the hatch and carry out operations in the elevator shaft in which the elevator car travels. A stay can extend between the first fulcrum and the second fulcrum for stabilizing the maintenance trestle.

The present invention meets the object of avoiding the disadvantages of the known equipment and of creating equipment for operations in an elevator shaft, which equipment does not represent a risk either for the engineer or for the elevator users in the elevator car.

The advantages achieved by the invention are essentially that there is no risk for the elevator car users of injury on parts of the maintenance trestle, because the maintenance trestle is located outside the standing region of the elevator car users. Moreover, there are no attack points for vandalism such as, for example, edges, hinges, joints, etc., at the car walls. The car interior is not adversely affected by the maintenance trestle. In terms of selling strategy the aesthetic presentation of the car interior is of great economic significance. The maintenance trestle according to the invention completely and entirely meets this requirement, for example by the invisible arrangement of the maintenance trestle.

The maintenance trestle according to the invention also has an increased load bearing capability, so that parts to be mounted or demounted in the shaft can be intermediately placed on the maintenance trestle. The position of the hatch or the ceiling opening in the roof of the elevator car can be so selected for the performance of operations in the elevator shaft that the hatch is not overlapped by shaft equipment arranged in the shaft head, wherein in this case the maintenance trestle lies in the projection of the hatch and moreover has a sufficiently large standing area. The position of the hatch, the sufficient standing area and the increased load-bearing capability of the maintenance trestle guarantee the safety of the engineer. Moreover, the maintenance trestle is extremely simple in operation and is quickly ready for use without effort.

DESCRIPTION OF THE DRAWINGS

The above, as well as other advantages of the present invention, will become readily apparent to those skilled in the art from the following detailed description of a preferred embodiment when considered in the light of the accompanying drawings in which.

DESCRIPTION OF THE PREFERRED EMBODIMENT

Figure 1:
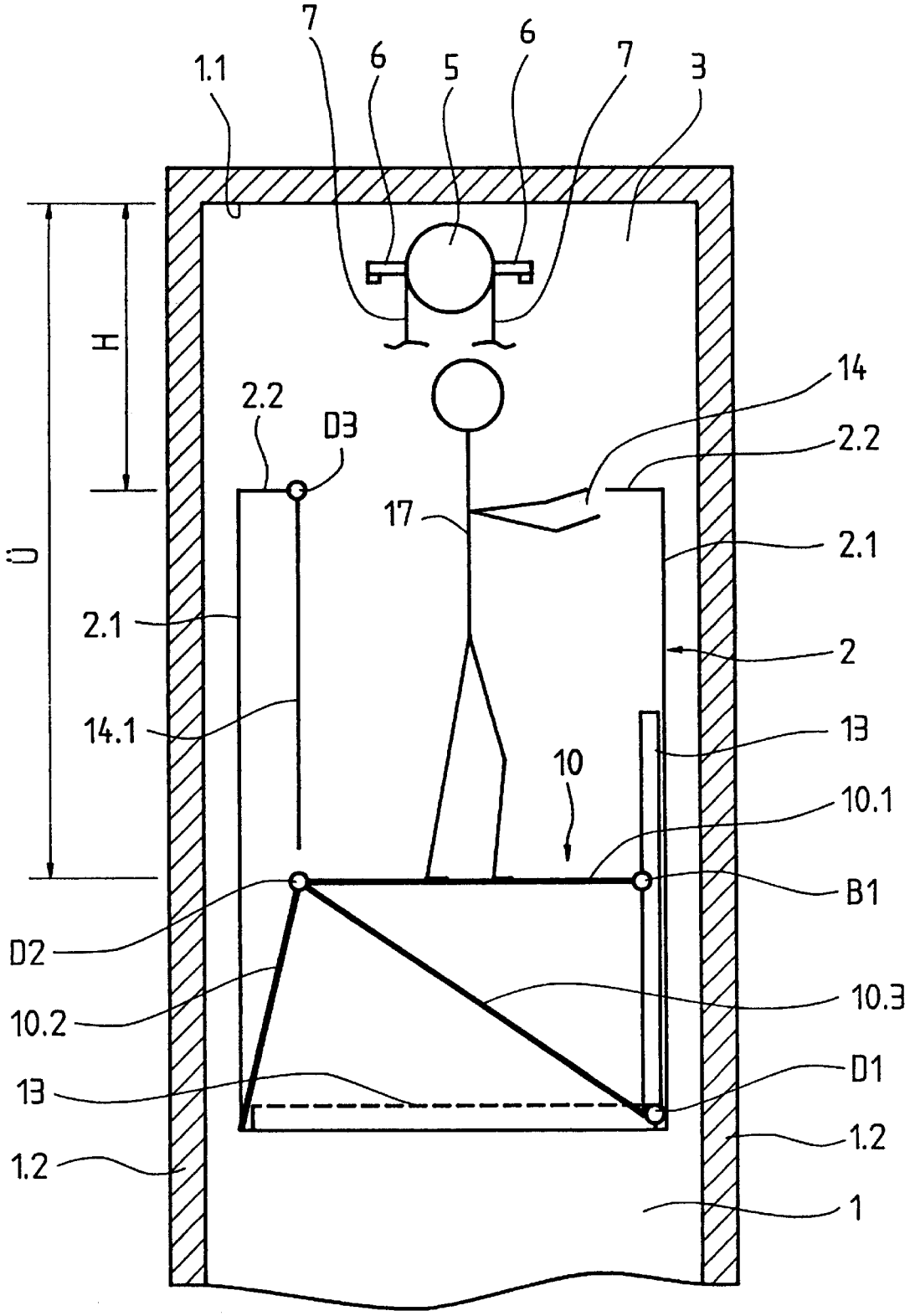
FIG. 1 is a schematic illustration of an elevator car that has a maintenance trestle according to the present invention, which car is stopped at the top stopping point in an elevator shaft with shortened shaft head.

An elevator shaft 1, in which an elevator car 2 is movable, is bounded by shaft walls 1.2. A drive pulley 5, which is connected with a drive that is not illustrated, is arranged in the shaft head 3. The drive pulley 5 and/or the drive is supported by, for example, a wall bracket 6 attached to one of the shaft walls 1.2. A carrying cable 7 has a cable course which is not illustrated, for example from a fixed point over a deflecting roller of the elevator car 2 or, in the case of a looping underneath, over two deflecting rollers, further over the drive pulley 5, further over a deflecting roller of a counterweight which is not illustrated and further to a further fixed point. The elevator car 2 includes a plurality of side walls 2.1 extending between a ceiling 2.2 and a floor to form a car interior.

A maintenance trestle 10 is arranged in the elevator car 2 and serves for the maintenance of elevator equipment, such as, for example, the drive pulley 5, a drive, the support cable 7, guide rails, elevator switches, etc. A standing area from which the operations in the elevator shaft 1 are carried out is provided in the form of a platform 10.1. For the transport of persons and goods, the maintenance trestle 10 is stowed under a movable portion 13 of the car floor. For maintenance operations in the elevator shaft 1, the maintenance trestle 10 can be erected as shown in FIG. 1.

The maintenance trestle 10 is stowed in folded-together form under the floor portion 13 of the elevator car 2. The floor portion 13, which can be the entire floor or any part thereof, is hinged along an edge at a first fulcrum D1. In order to erect the maintenance trestle 10, the floor 13 is, for example, tilted up about the hinged edge along the first fulcrum D1 towards a car wall 2.1. The maintenance trestle 10 is now accessible, in folded-together form, for erection in the interior of the car. The platform 10.1 is connectable in accordance with the respective width at one edge to at least one fastening point B1 disposed at the bottom side of the folded-up floor 13, wherein the floor serves as a support for the platform 10.1. At least one support 10.2 has one end hinged at the platform 10.1 at the opposite edge from the fastening point B1, wherein the support 10.2 is tiltable about a second fulcrum D2. An opposite end of the support 10.2 can be engaged with the interior of the car 2, on the side wall 2.1 or at the floor, to support the platform 10.1. For stabilizing the maintenance trestle 10, at least one strut 10.3, for example a rod or a cable, is provided, which as shown in FIG. 1 arranged between fulcra D1 and D2.

The platform 10.1 can be adjustable in height. For that purpose the fastening point B1 is slidably attached to the bottom side of the floor portion 13 on, for example, a vertically extending rail. After selection of the desired height, the fastening point B1 is releasably fixed to the rail. The support 10.2 and the stay 10.3 are, for example, constructed to be telescopic and are extensible or retractable to the desired length to maintain the platform 10.1 level.

In a variant of embodiment the floor 13 is removable in the region of the maintenance trestle 10. In this case, the maintenance trestle 10 has one of the supports 10.2 on each side and at least one stay 10.3 per diagonal. The removable floor part then serves as the platform 10.1.

In another variant of embodiment the maintenance trestle 10 can be inflatable, wherein the floor portion 13 serves as the platform 10.1. Foldable lifters operated by pressure medium and, for example, in bellows form serve as the platform elevator and as supports and bring the platform 10.1 into working setting.

A hatch 14, which is closable by means of a hatch cover 14.1, is provided in the roof of the elevator car 2. As FIG. 1 shows, the hatch cover 14.1 is tiltable about a third fulcrum D3, but it can also be constructed as a removable hatch cover.

The position and the size of the hatch 14 are so selected that the hatch 14 is not overlapped by shaft equipment, such as, for example, the drive pulley 5 and/or by the drive, arranged in the shaft head 3. The shown elevator disposition, without a machine room, offers, by its shortened shaft head 3, for the maintenance of the car roof an insufficient height H for a prescribed over-travel (distance between a car ceiling 2.2 and a shaft ceiling 1.1) of, for example, one meter. With the maintenance trestle 10 according to the invention in the shown working setting, the safety of the engineer 17 is taken care of and the required over-travel Ü achieved, because the distance between the car ceiling 2.2 and the shaft ceiling 1.1 is no longer determinative, but rather the distance between the platform 10.1 and the shaft ceiling 1.1, and because no shaft equipment in the shaft head 3 overlaps the hatch 14.

In accordance with the provisions of the patent statutes, the present invention has been described in what is considered to represent its preferred embodiment. However, it should be noted that the invention can be practiced otherwise than as specifically illustrated and described without departing from its spirit or scope.

What is claimed is:

1. Equipment for carrying out operations in an elevator shaft in which an elevator car is movable, the car including side walls extending between a floor and a ceiling forming a car interior, the ceiling having a hatch therein for accessing the elevator shaft from the car interior, comprising:

a maintenance trestle having a platform for supporting a person in an elevator car in an upwardly extended position; and a support means attached to said platform whereby when said platform and said support means are mounted in a floor of the elevator car under a movable portion of the floor, said platform and said support means are extensible from a stored position in the floor to the upwardly extended position in a car interior from which a person standing on said platform can reach through a hatch in a ceiling of the elevator car and carry out operations in an elevator shaft in which the elevator car travels.

2. The equipment according to claim 1 wherein said maintenance trestle is collapsible from the extended position to the stored position.

3. The equipment according to claim 1 wherein said support means includes at least one support extending between said platform and the interior of the elevator car for holding said platform in the extended position.

4. The equipment according to claim 3 wherein said one support has one end attached to said platform at one fulcrum and wherein said support means includes a strut extending between said one fulcrum and another fulcrum at the floor of the elevator car for stabilizing said maintenance trestle.

5. The equipment according to claim 4 wherein said one support and said strut are telescopic.

6. The equipment according to claim 1 wherein said maintenance trestle is positioned beneath the floor in the stored position, the movable floor portion being tiltable toward a wall of the elevator car to expose said maintenance trestle.

7. The equipment according to claim 6 wherein said platform is attached to a bottom side of the movable floor portion for support.

8. The equipment according to claim 6 wherein said platform is slidably attached to a bottom side of the movable floor portion for adjusting a height of said platform in the extended position.

9. An elevator car movable in an elevator shaft, comprising:

a plurality of side walls extending between a floor and a ceiling to form a car interior, said ceiling having a hatch formed therein for access to an elevator shaft from the interior, at least a portion of said floor being tiltable toward one of said walls at a first fulcrum; and a maintenance trestle stowable under said floor movable portion and having a platform for supporting a person and at least one foldable support attached to said platform, said platform being hinged to a bottom side of said floor movable portion for supporting said platform in an extended position in said car interior when said floor movable portion is tilted toward said one wall, said foldable support being hinged to said platform at a second fulcrum and engaging said car interior for supporting said platform in the extended position whereby a person standing on said platform in the extended position can reach through said hatch and carry out operations in the elevator shaft in which the elevator car travels.

10. The elevator car according to claim 9 including a strut extending between said first fulcrum and said second fulcrum for stabilizing said maintenance trestle.

11. The elevator car according to claim 10 wherein said foldable support and said strut are telescopic.

* * * * *